US006238192B1

(12) United States Patent
Lee

(10) Patent No.: US 6,238,192 B1
(45) Date of Patent: May 29, 2001

(54) INNER CORE/CYLINDER BLOCK ASSEMBLY FOR LINEAR COMPRESSOR AND METHOD FOR ASSEMBLING THE SAME

(75) Inventor: Sung-Jae Lee, Anyang (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/346,889

(22) Filed: Jul. 2, 1999

(30) Foreign Application Priority Data

Jul. 3, 1998 (KR) ..... 98-26867

(51) Int. Cl.[7] ..... F04B 17/04
(52) U.S. Cl. ..... 417/417; 310/14; 310/217
(58) Field of Search ..... 417/417; 310/14, 310/23, 34, 217

(56) References Cited

U.S. PATENT DOCUMENTS 5,003,212 * 3/1991 Ibe et al. ..... 310/235
5,704,771 * 1/1998 Fujisawa et al. ..... 417/417
6,077,054 * 6/2000 Lee et al. ..... 417/417
6,084,320 * 7/2000 Morita et al. ..... 310/12

FOREIGN PATENT DOCUMENTS

209517 * 7/1957 (AU) ..... 417/417
848889 * 9/1960 (GB) ..... 417/417
905095 * 9/1962 (GB) ..... 417/417
8-275413 10/1996 (JP) .
96-39553 11/1996 (KR) .

* cited by examiner

*Primary Examiner*—Cheryl J. Tyler
(74) *Attorney, Agent, or Firm*—Larson & Taylor, PLC

(57) ABSTRACT

A linear compressor includes a cylinder block in which a compressing chamber is formed; and an inner core having a plurality of electric steel plates disposed around the cylinder block. The cylinder block extends into spaces between the electric steel plates so that the cylinder block is integrally formed with the inner core. Each of the electric steel plates includes an insertion projection extending from a surface toward the cylinder block and an insertion step extending upward and downward from the insertion projection to form a concave between the surface and the insertion step, the cylinder block extending into the concave to interlock with the inner core.

2 Claims, 8 Drawing Sheets

INNER CORE/CYLINDER BLOCK ASSEMBLY FOR LINEAR COMPRESSOR AND METHOD FOR ASSEMBLING THE SAME

BACKGROUND OF THE INVENTION

1. Field of the Invention

The present invention relates to a linear compressor and, more particularly, to an inner core/cylinder block assembly for a linear compressor and a method for assembling the same.

2. Description of the Related Art

In general, a linear compressor is used in a refrigeration system that provides refrigeration energy by having a refrigerant undergo the successive process of compressing, condensing, expanding and evaporating. The linear compressor has a linear motor, which is driven by electromagnetic force created by the alternate direction change of magnetic flux, to compress the refrigerant at high temperature and pressure.

FIG. 1 shows a conventional linear compressor, and FIG. 2 shows an inner core of the conventional linear compressor.

As shown in the drawings, the conventional linear compressor comprises an airtight container 10, a driving part generating a driving force in the airtight container 10, and a compressing part inhaling, compressing and discharging a refrigerant by using the driving force of the driving part.

The compressing part comprises a piston 11 and a cylinder block 13 provided with a compressing chamber 12 in which the piston 11 is slidably disposed. On one end of the cylinder block 13 is mounted a cylinder head 16 in which an inhaling chamber 14 and a discharging chamber 15 are provided for guiding the refrigerant to the inside and outside of the compressing chamber 12, respectively.

The driving part comprises an inner core 20 coupled on an outer surface of the cylinder block 13, a stator 30 spaced away from the inner core 20 at a predetermined distance, a permanent magnet 22 disposed between the inner core 20 and the stator 30 to interact with an electric field formed by the stator 30.

The stator 30 includes a cylindrical bobbin 31, coils 32 wound around the bobbin 31, and outer core 33 inserted into the bobbin 31.

On the lower end of the piston 11 is provided a fixing shaft 11*a* with a frame 40 for fixing the permanent magnet 22. A resonant spring 41 for elastically supporting the piston 11 is connected to the lower end of the fixing shaft 11*a* to raise compressing force of the piston 11.

The inner core 20 is made by piling up rectangular-shaped electric steel plates 21 and is arranged radially along the outer circumference of the cylinder block 13. Korean laid-open patent No. 96-39553 discloses a method for piling the steel plates 21 and assembling the inner core 20 and the cylinder block 13. This will be described hereinafter with reference to FIG. 2.

Each steel plate is first magnetized by a magnetic flux generating device (not shown), then the magnetized steel plates 21 are radially disposed about a holder 50.

The holder 50 includes a cylindrical main body 51, an inner extending portion 52 extending inwardly at the lower end of the main body 51, and an outer extending portion 53 extending outwardly at the lower end of the main body 51. The inner extending portion 52 is provided with a plurality of screw holes 52*a* so that the holder 50 can be coupled on the lower end of the cylinder block 13 by a screw 54. Each magnetized steel plate 21 is disposed on the outer extending portion 53.

The magnetized steel plates 21 disposed on the holder 50 are fixed by an adhesive, thereby obtaining a radially piled inner core 20. And, the holder 50 is coupled to the cylinder block 13 by screw-coupling the screws 54 through the screw holes 52*a*, thereby completing the coupling process of the holder 50 to the cylinder block 13.

However, in the conventional compressor, to dispose the steel plate 21 on the holder 50, a special magnetic flux generating device is required, making the manufacturing process complicated. In addition, since the steel plates 21 are attached on the holder 50 by an adhesive, the same may be easily removed by external force, deteriorating the performance of the compressor. Furthermore, to assemble the inner core 20 on the cylinder block 13, additional fastening members such as the holder 50 and the screws 54 are required, lowering the productivity and increasing the manufacturing costs.

SUMMARY OF THE INVENTION

The present invention has been made in an effort to solve the above problems.

It is an objective of the present invention to provide a linear compressor which can be easily manufactured with the low costs and a method for manufacturing the same.

To achieve the above objective, the present invention provides a linear compressor comprising a cylinder block in which a compressing chamber is formed; and an inner core having a plurality of electric steel plates disposed around the cylinder block, wherein the cylinder block extends into spaces between the electric steel plates so that the cylinder block is integrally formed with the inner core.

Each of the electric steel plates comprises an insertion projection extending from a surface toward the cylinder block and an insertion step extending upward and downward from the insertion projection to form a concave between the surface and the insertion step, the cylinder block extending into the concave to interlock with the inner core.

According to another aspect of the present invention, a method for manufacturing the linear compressor comprising the steps of punching each of the electric steel plates; radially stacking the electric steel plates; welding the electric steel plates to form the inner core; inserting the inner core into a cast mold for casting the cylinder block; pouring molten material into the cast mold and applying pressure to the cast mold so that the molten material is filled into spaces between the electric steel plates, thereby making the inner core integral with the cylinder block.

The punching step further comprises the steps of forming an insertion projection on a surface of the electric steel plate; and forming an insertion step on the insertion projection. The stacking step further comprises the steps of preparing a jig having an insertion groove; and stacking the electric steel plates along the jig in a semi-cylindrical shape by inserting the insertion step into the insertion groove.

The welding step further comprises the step of welding the electric steel plates along the insertion steps. The method further comprises the step of making a pair of inner cores inserted into the cast mold.

The punching step further comprises the steps of forming an insertion projection on a surface of the electric steel plate and forming an insertion step on the insertion projection to form a concave between the insertion step and the surface.

The molten material is filled into the concave during the pouring step.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will now be described in detail with reference to the accompanying drawings.

Figure 1:
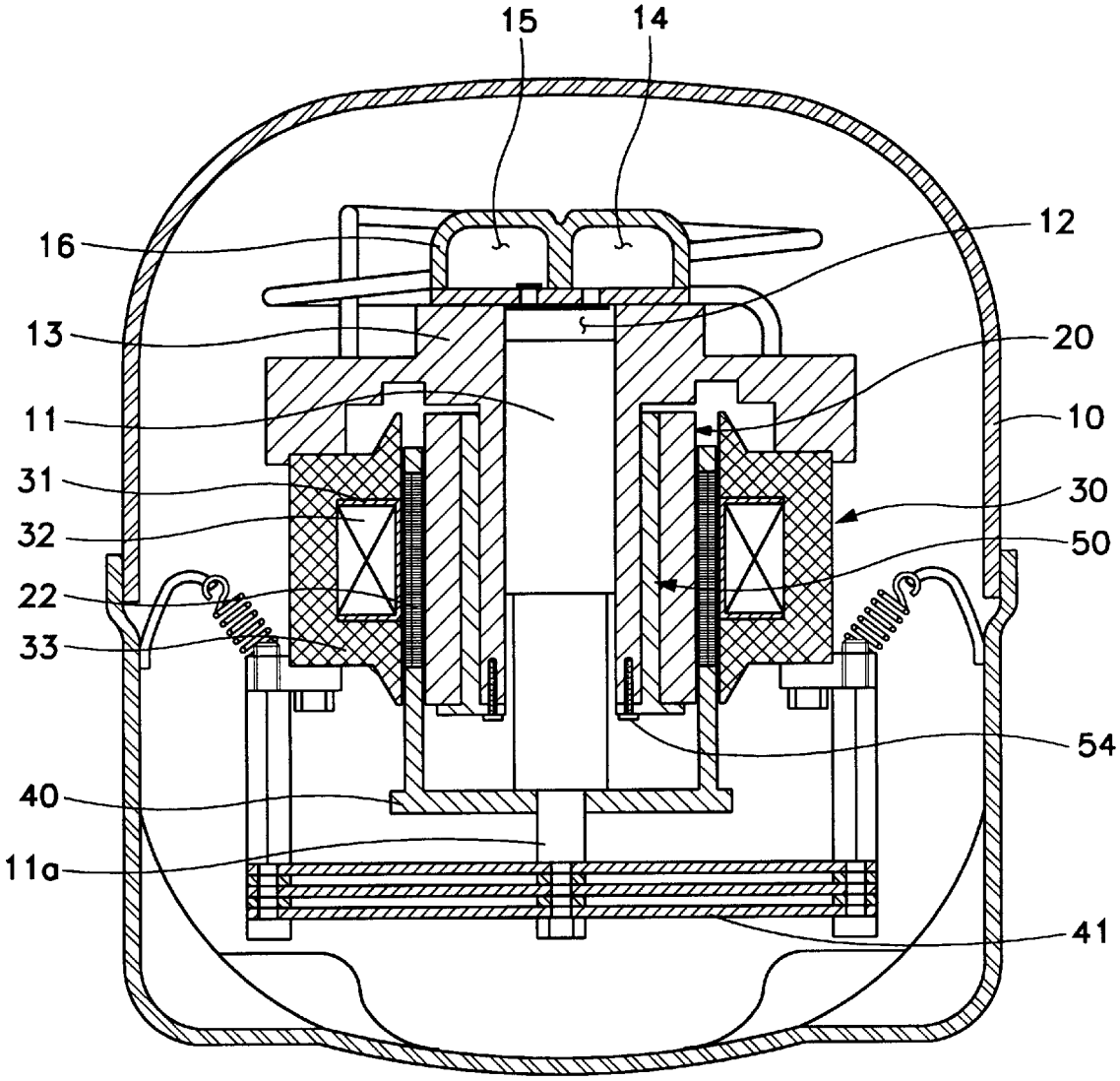
Fig. 1 (PRIOR ART)
FIG. 1 is a sectional view of a conventional linear compressor.
Figure 2:
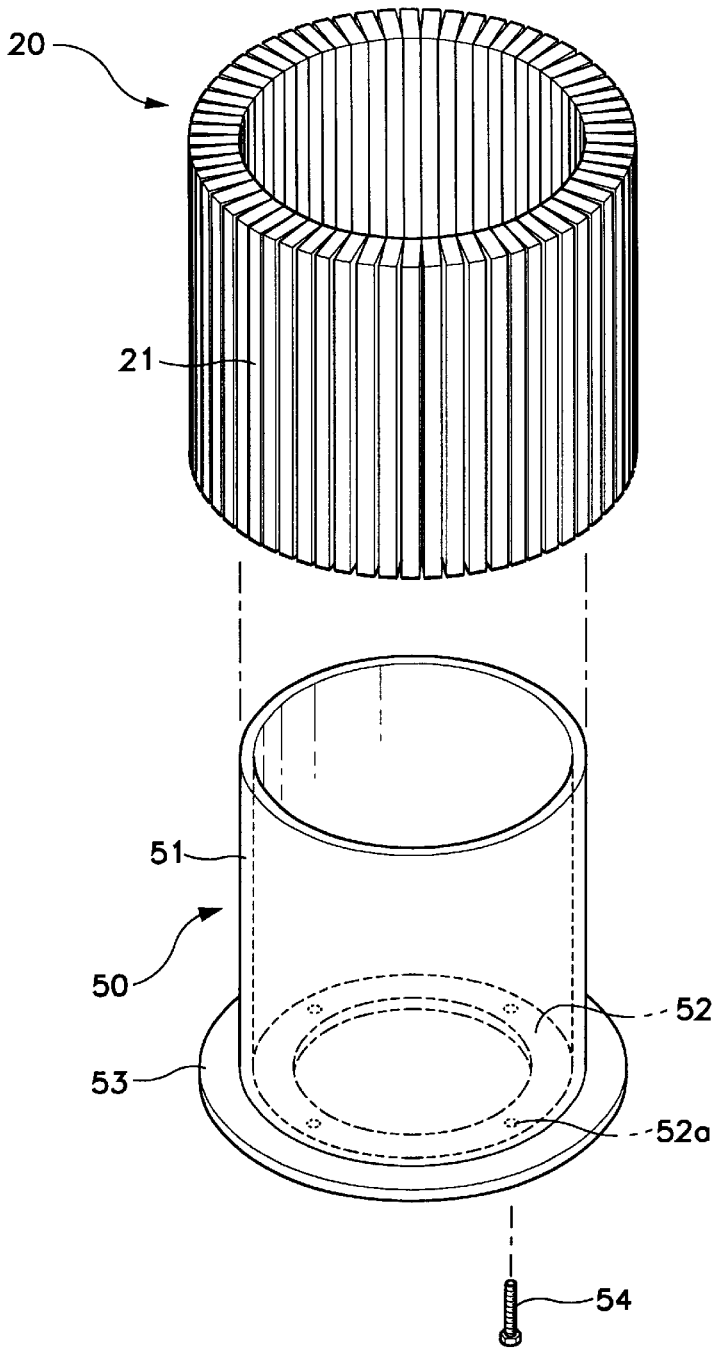
Fig. 2 (PRIOR ART)
FIG. 2 is a perspective view illustrating an inner core of a conventional linear compressor.
Figure 3:
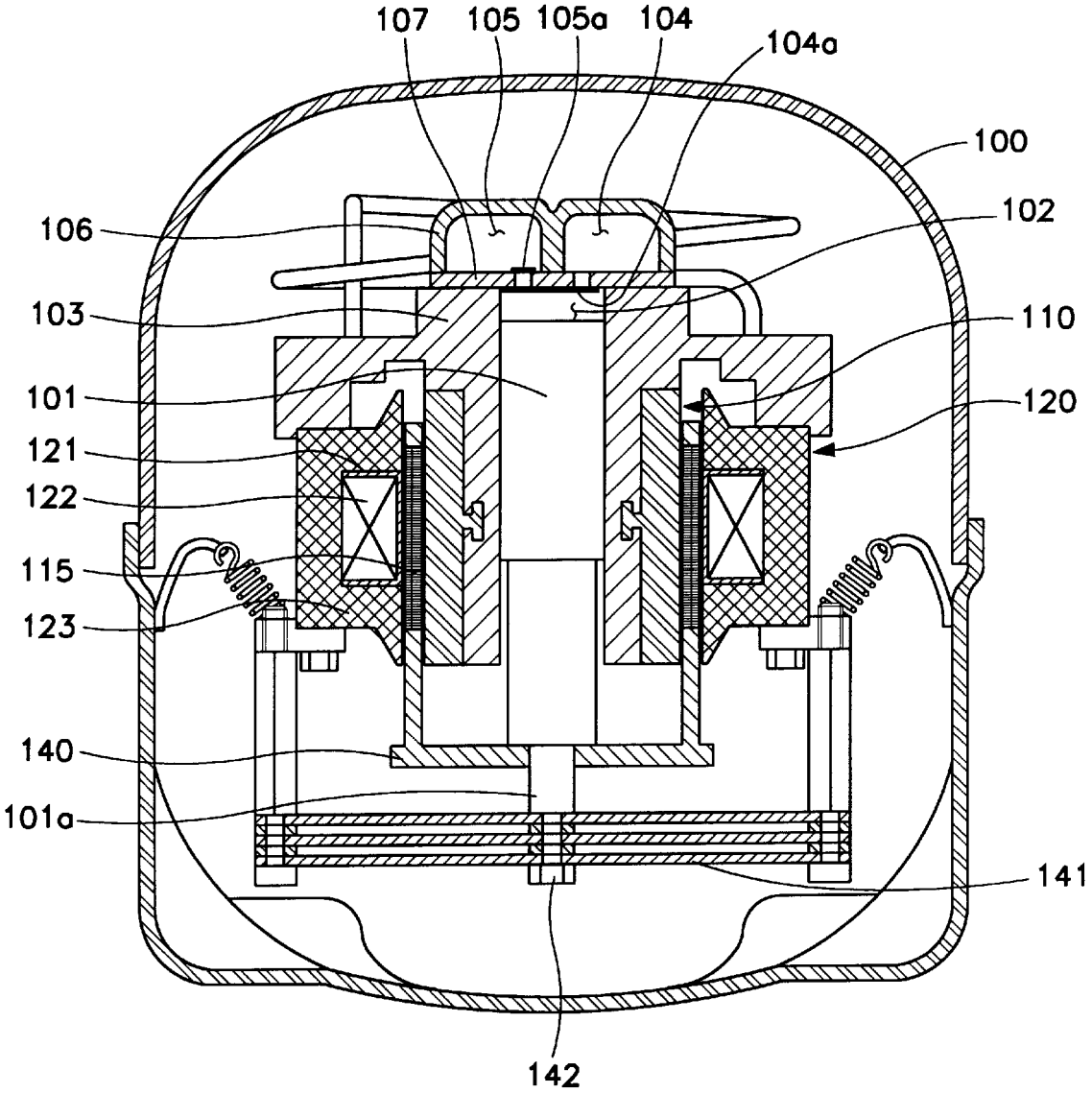
FIG. 3 is a sectional view of a linear compressor according to a preferred embodiment of the present invention.

FIG. 3 shows a linear compressor according to a preferred embodiment of the present invention.

The inventive linear compressor comprises an airtight container 100, a driving part generating a driving force in the airtight container 100, and a compressing part inhaling, compressing and discharging a refrigerant by using the driving force of the driving part.

The compressing part comprises a piston 101, and a cylinder block 103 provided with a compressing chamber 102 in which the piston 101 is slidably disposed. On one end of the cylinder block 103 is mounted a cylinder head 106 in which an inhaling chamber 104 and a discharging chamber 105 are provided for guiding the refrigerant to the inside and outside of the compressing chamber 102, respectively. A valve plate 107 on which inhaling valve 104*a* and discharging valve 105*a* are formed is mounted between the cylinder block 103 and the cylinder head 106 to open and close the inhaling chamber 104 and the discharging chamber 105, respectively.

The driving part comprises an inner core 110 coupled around the cylinder block 103, a stator 120 disposed away from the inner core 110 at a predetermined distance, and a permanent magnet 115 disposed between the inner core 110 and the stator 120 to interact with an electric field formed by the stator 120.

As a feature of the present invention, the inner core 110 is integrally coupled to the cylinder block 103 without using a coupling member. This will be described more in detail hereinbelow.

In addition, the stator 120 includes a bobbin 121 of a cylindrical shape having a recess for winding coils at the outer circumference thereof, coils 122 wound in the coil winding recess of the bobbin 121, and outer core 123 inserted into the bobbin 121.

On the lower end of the piston 101 is provided a fixing shaft 101*a* with a frame 140 for fixing the permanent magnet 115. A resonant spring 141 for elastically supporting the piston 101 is connected to the lower end of the fixing shaft 101*a* by means of a bolt 142 to raise compressing force of the piston 101.

The structures of the inner core 110 and the cylinder block 103 will be described hereinafter with reference to FIGS. 4 to 8.

Figure 4:
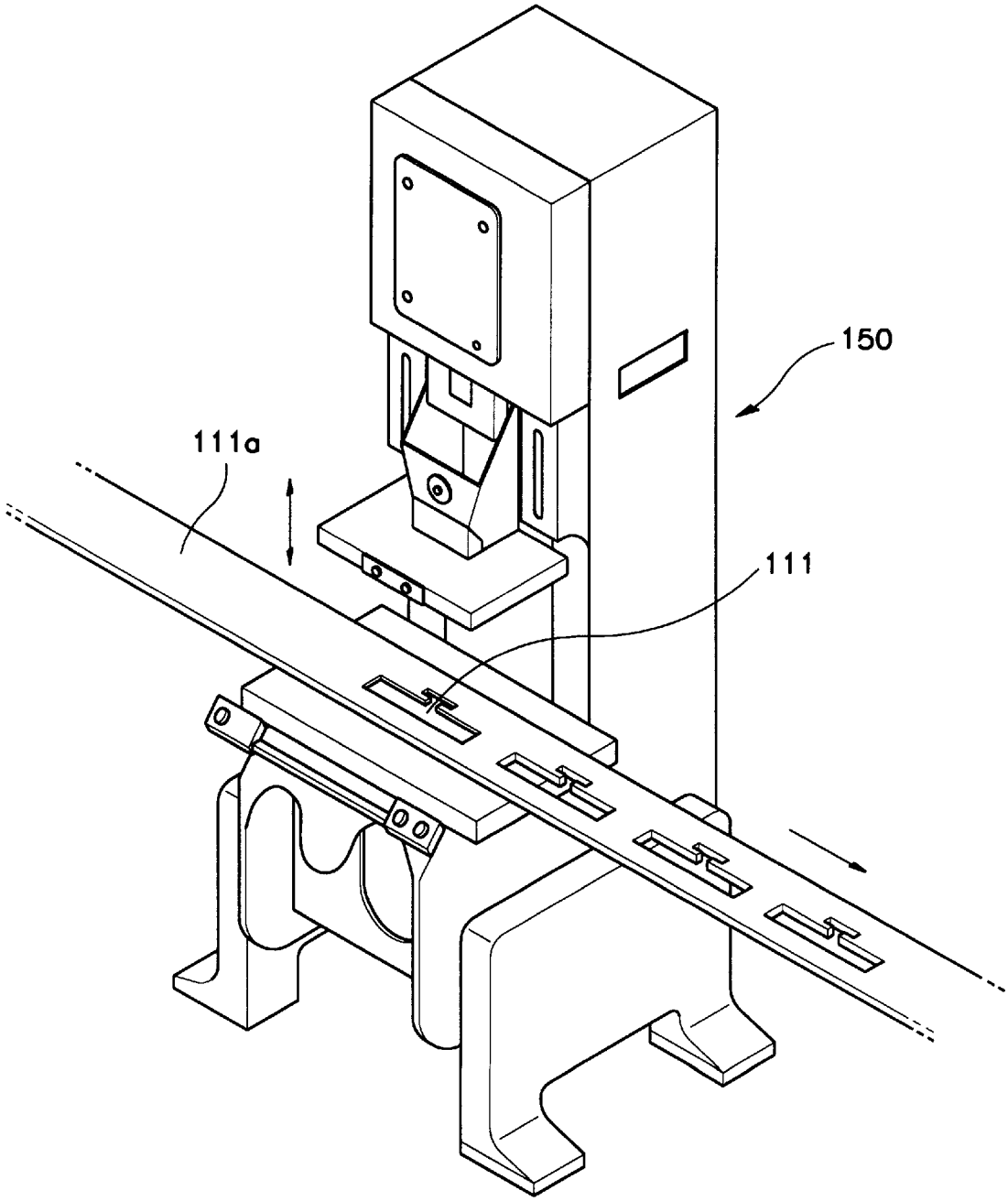
FIG. 4 is a perspective view illustrating a punching process of an inner core of a linear compressor according to a preferred embodiment of the present invention.
Figure 5:
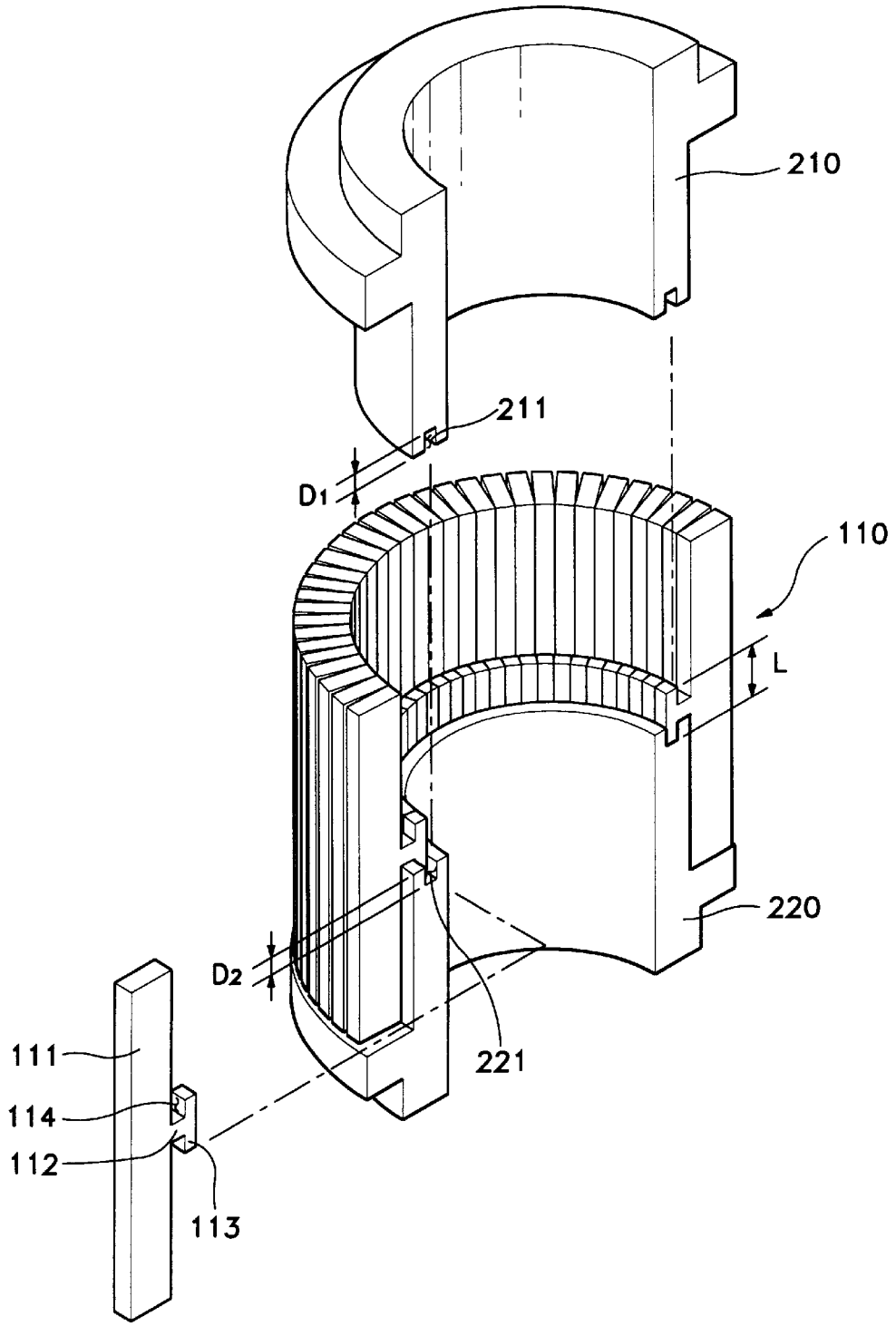
FIG. 5 is a perspective view illustrating a piling process of an inner core of a linear compressor according to a preferred embodiment of the present invention.

Generally, the inner core 110 of the linear compressor is made by piling a plurality of rectangular electric steel plates. As shown in FIG. 4, the electric steel plate 111 of the present invention is made by punching a material plate 111*a* by a press 150 while it is conveyed by a conveying system (not shown). As shown in FIG. 5, in the punching process, an insertion projection 112 is formed on a surface of the electric steel plate 111 and an insertion step 113 is formed extending from an extreme end of the insertion projection 112 in upper and lower directions, thereby forming a concavity 114 between the surface of the electric steel plate 111 and the insertion step 113.

The electric steel plate 111 having undergone the punching process forms the inner core 110 through a stacking process. At this point, semi-cylindrical jigs 210 and 220 are prepared to guide the stacking process of the electric steel plate 111.

Describing more in detail, the jigs 210 and 220 are separated in upper and lower sides, and the insertion step 113 of the electric steel plate 111 is disposed between the upper and lower jigs 210 and 220.

Lower and upper ends of the respective upper and lower jigs 210 and 220 are provided with a circumferential insertion groove 211 and 221 in which the insertion step 113 of the electric steel plate 111 is inserted. That is, in a state where the insertion groove 211 of the upper jig 210 and the insertion groove 221 of the lower jig 220 is in an opposing state to each other, the insertion step 113 of the electric steel plate 111 is inserted into the insertion groove 211 and 221. Accordingly, the electric steel plates 111 are stacked in a semi-cylindrical shape while being guided by the shape of the jigs 210 and 220, thereby forming the inner core 110.

Figure 6:
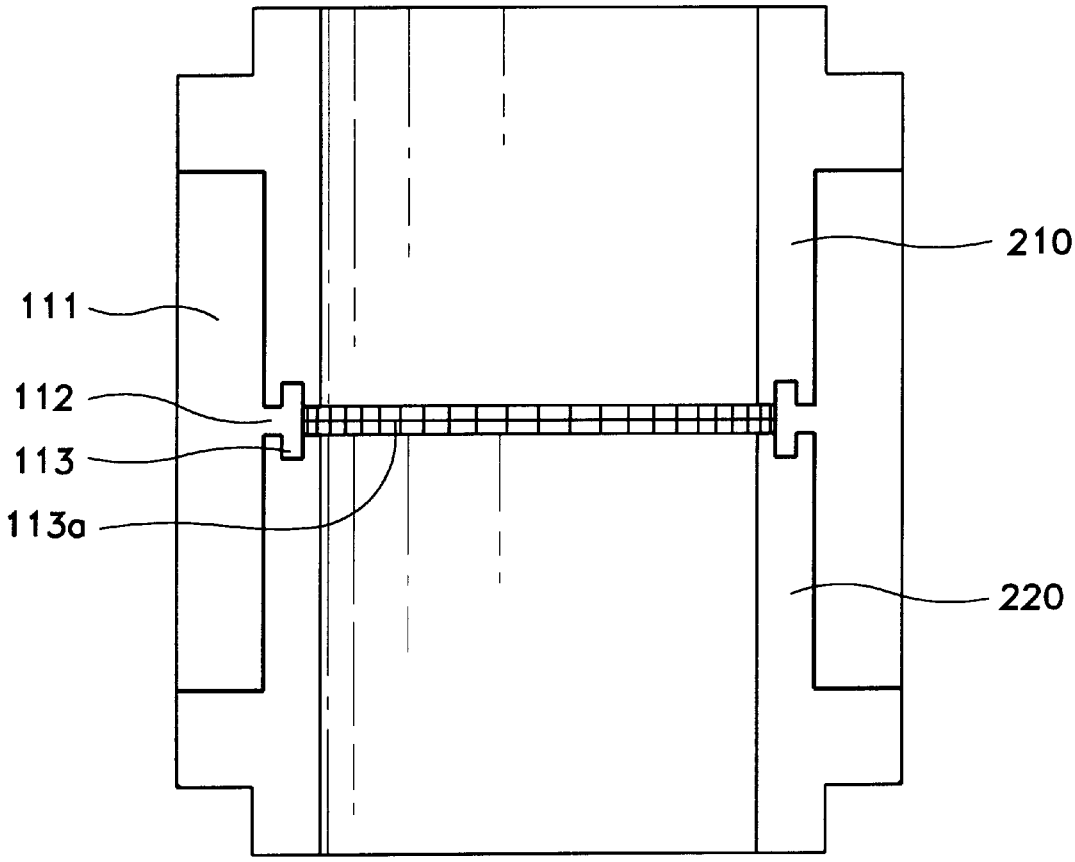
FIG. 6 is a side view illustrating a welding process of an inner core of a linear compressor according to a preferred embodiment of the present invention.

When the stacking process is completed, as shown in FIG. 6, a welding process is conducted to fix the stacked electric steel plates 111. The welding process is conducted along a central portion 113*a* of the insertion step 113.

At this point, the length L of the insertion step 113 should be designed to be larger than a sum of the depth D1 of the insertion groove 211 of the upper jig 210 and the depth D2 of the insertion groove 221 of the lower jig 220. This is to obtain a space for welding the electric steel plates 111 along the central portion 113*a* of the insertion step 113.

When the welding process is completed, the jigs 210 and 220 are removed from the inner core 110.

After the above, an assembling process is conducted for assembling the inner core 110 with the cylinder block 103. This will be described more in detail hereinafter.

Figure 7:
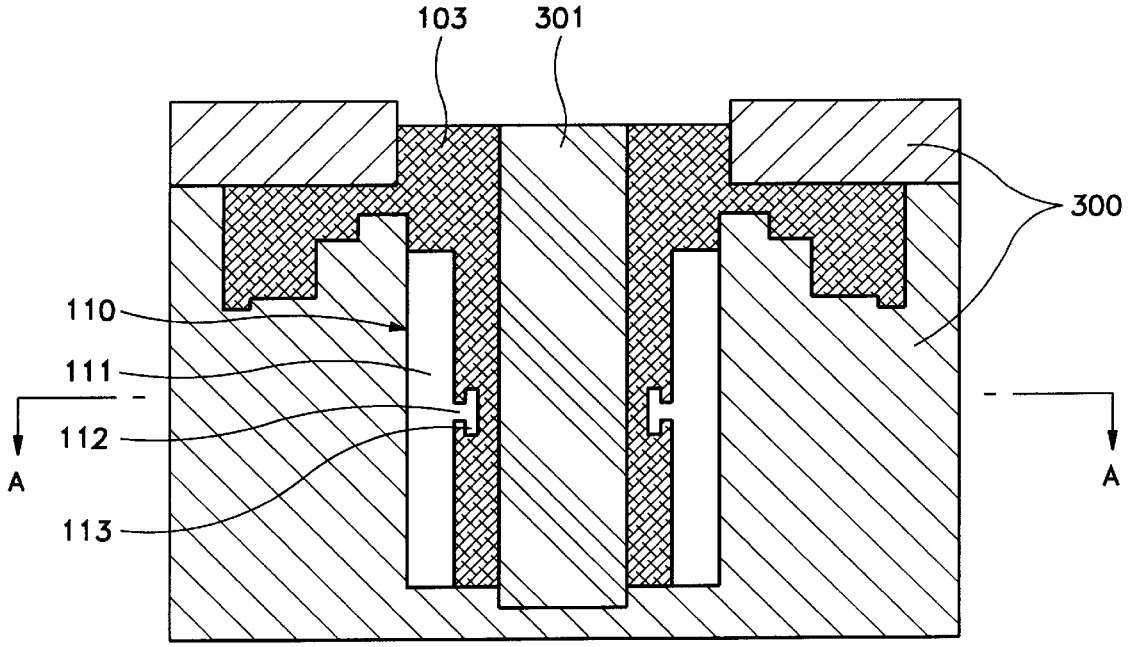
FIG. 7 is a sectional view illustrating a die casting process of an inner core on a cylinder block of a linear compressor according to a preferred embodiment of the present invention.

Generally, the cylinder block 103 is made of a nonmagnetic material through a die casting process. In the die casting process, as shown in FIG. 7, a cast mold 300 is first prepared to cast the cylinder block 103, and a nonmagnetic molten material is poured into the cast mold 300. At this point, before pouring the molten material into the cast mold 300, a pair of inner cores 110 are inserted into the cast mold 300 such that the insertion steps 113 of the pair of inner cores 110 face a center of the cast mold 300 to make the pair of inner cores cylindrical.

Figure 8:
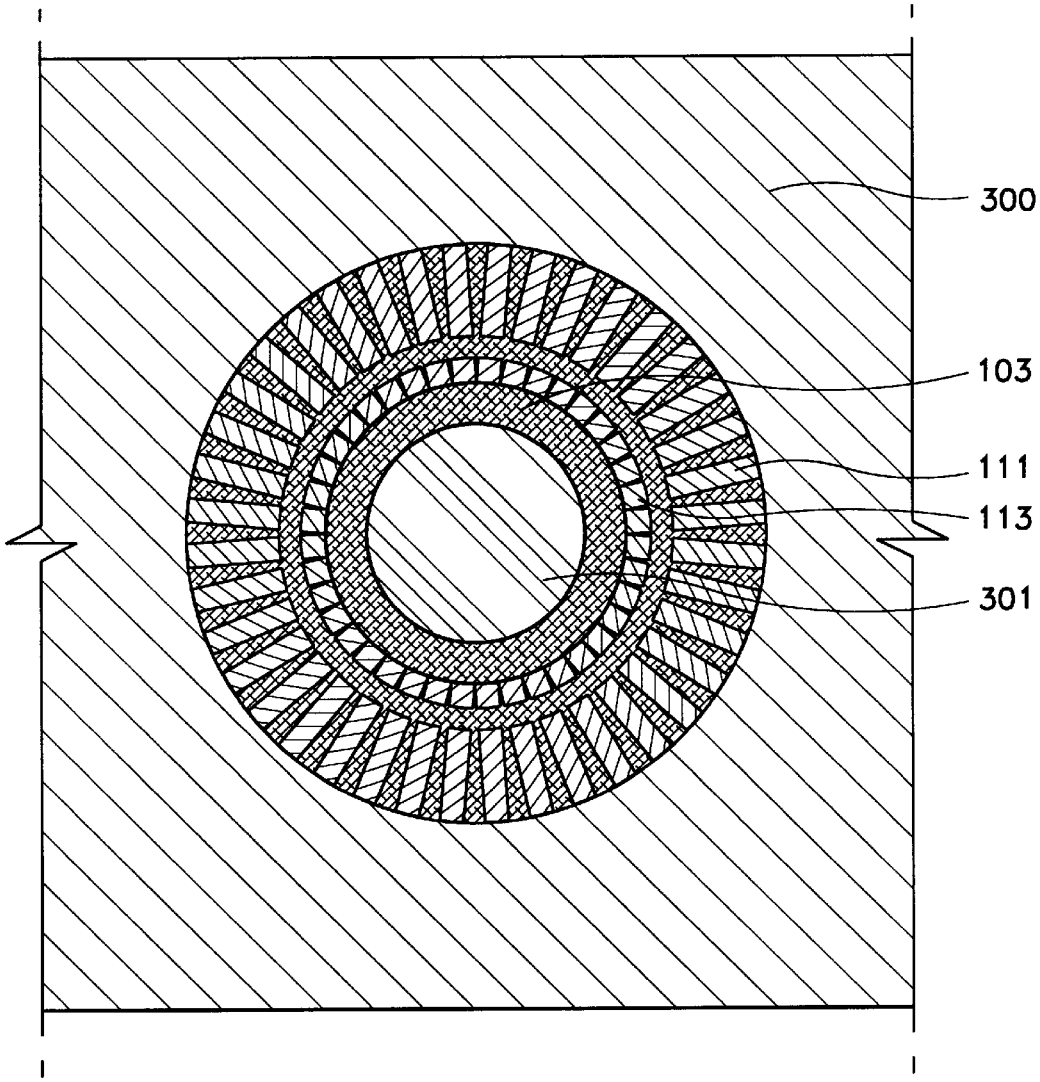
FIG. 8 is a sectional view taken along line A—A of FIG. 7.

After the above, the molten material is poured into the cast mold 300, then a pressure is applied to the cast mold 300. At this point, as shown in FIG. 8, the molten material is filled into spaces between the electric steel plates 111 and the concavity 114 formed on each of the electric steel plates 111. That is, the inner core 110 is integrally formed with the cylinder block 103. Preferably, the molten material is aluminum.

In addition, during the die casting process, a cylindrical core 301 is disposed on a central portion of the cast mold 300 to form the compressing chamber 102 (see FIG. 3) within the cylinder block 103.

As described above, the electric steel plates of the inventive linear compressor can be easily stacked by using jigs, making the manufacturing process simple. Furthermore, the inner core formed by welding the stacked electric steel plates is integrally coupled to the cylinder block during the die casting process, thereby conventional coupling members such as a holer and screws and the assembling process of the same being unnecessary, the productivity being raised, and the manufacturing costs being decreased.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A linear compressor comprising:

a cylinder block in which a compressing chamber is formed; and an inner core having a plurality of electric steel plates disposed around the cylinder block, wherein the cylinder block extends into spaces between the electric steel plates so that the cylinder block is integrally formed with the inner core, each of the electric steel plates comprising an insertion projection extending from a surface toward the cylinder block and an insertion step extending vertically from the insertion projection to form a concavity between the surface and the insertion step, the cylinder block extending into the concavity to interlock with the inner core.

2. The linear compressor of claim 1, wherein the insertion step extends both upwardly and downwardly from the insertion projection.

* * * * *